US006604463B1

(12) United States Patent
Smith

(10) Patent No.: US 6,604,463 B1
(45) Date of Patent: Aug. 12, 2003

(54) DEVICE TO COMPENSATE FOR PRINT MISREGISTER DUE TO PAPER DISTORTION ON WEB OFFSET PRINTING PRESSES

(76) Inventor: Roy Gordon Smith, 7/24 Eden Street, Arncliffe, New South Wales, 2205 (AU)

( * ) Notice: Subject to any disclaimer, the term of this patent is extended or adjusted under 35 U.S.C. 154(b) by 0 days.

(21) Appl. No.: 09/719,921

(22) PCT Filed: Jun. 19, 1999

(86) PCT No.: PCT/AU99/00484

§ 371 (c)(1),
(2), (4) Date: Dec. 15, 2000

(87) PCT Pub. No.: WO99/65682

PCT Pub. Date: Dec. 23, 1999

(30) Foreign Application Priority Data

Jun. 16, 1998 (AU) ..... PP 4115
Aug. 12, 1998 (AU) ..... 79926/98

(51) Int. Cl.[7] ..... B41F 13/56

(52) U.S. Cl. ..... 101/228; 226/97.1; 226/97.3; 226/7

(58) Field of Search ..... 101/222, 227, 101/228, 424.1, 181, 226; 226/3, 7, 18, 75, 196.1, 97.1, 97.2, 97.3

(56) References Cited

U.S. PATENT DOCUMENTS 3,622,058 A * 11/1971 Vita ..... 101/228
4,031,741 A * 6/1977 Schaming ..... 73/37.7
4,385,716 A * 5/1983 De Roeck et al. ..... 226/18
4,833,794 A * 5/1989 Stibble et al. ..... 101/424.1
4,989,461 A 2/1991 Nishiwaki et al. ..... 73/862.45
5,056,431 A * 10/1991 Sainio ..... 101/227
5,345,863 A * 9/1994 Kurata et al. ..... 101/181
5,553,542 A * 9/1996 Jackson et al. ..... 101/228
5,794,829 A * 8/1998 Perrault ..... 226/18
5,832,826 A 11/1998 Mack et al. ..... 101/231

FOREIGN PATENT DOCUMENTS

JP 7101047 4/1995
JP 9327903 12/1997

* cited by examiner

*Primary Examiner*—Eugene H. Eickholt
(74) *Attorney, Agent, or Firm*—Edwin D. Schindler

(57) ABSTRACT

A printing web distortion device for imposing a measured amount of distortion into a moving web of substrate, such as paper, to compensate for lateral stretching of the substrate during a printing operation includes a post, which can be vertically adjusted, having a gas nozzle disposed at, or adjacent to, the tip of the post for generating a cushion of a gas. A support enclosure for the post has a source for pressurized gas. The post is able to slide longitudinally within the support enclosure, so that the tip of the post is either raised in an operating mode, so that the post imposes a stretch compensating distortion or, in an idle mode, the post is withdrawn from the substrate, so that no elevating force is provided on the substrate. In the operating mode, the stretch compensating distortion results from an elevating force provided by the post between the tip of the post and the moving substrate resulting from the cushion of gas, which is preferably a cushion of air.

23 Claims, 3 Drawing Sheets

DEVICE TO COMPENSATE FOR PRINT MISREGISTER DUE TO PAPER DISTORTION ON WEB OFFSET PRINTING PRESSES

FIELD OF THE INVENTION

This invention relates to printing apparatus. More particularly, although not exclusively, it discloses an improved device, which compensates for the stretching of paper substrates during web offset or other printing processes. Although the following description refers to offset printing of paper, the invention need not be limited thereto, as other forms of printing including, for example, textile printing, may benefit from the principles embodied in the invention, by suitable adaptation where necessary.

BACKGROUND OF THE INVENTION

Web offset printing processes involve the application of pressure and tension forces to the paper substrate as well as the simultaneous use of damping chemicals on the printing plate. The effects of these combine to cause the substrate to stretch laterally following each printing impression. The degree of stretching can vary from a small fraction of a millimetre to as much as two millimetres over a web one metre wide. This constitutes a substantial problem on multicolour presses where four or more colours are printed in series since the images then fail to accurately superimpose upon one another.

Currently it is known to install small "bustle wheels" under the web path, which protrude upwardly to distort the paper immediately prior to the second and subsequent image prints. The height of the wheels is accurately adjusted to distort the web a measured amount just sufficient to compensate for any stretching. This system has the disadvantage however that the wheels have to actually contact the substrate in order to distort it. The wheels therefore leave a track through the wet ink previously printed and thus they can only be applied to waste areas that are later trimmed away. Also, the distorting force required from the wheels at full production speeds is often so excessive that at idle speed or start up the substrate is ruptured. Accordingly, the position of these wheels has to be monitored and changed with the speed of the substrate.

It is also known to distort the web using jets of gas from fixed nozzles, however this has proved to be difficult to manage as the jets exhaust a massive volume of compressed air and the pressure has to be continuously monitored and adjusted over as many as twenty nozzles with a typical press.

OBJECT OF THE INVENTION

It is an object of the present invention to ameliorate some or all of the aforementioned disadvantages by providing a device for controlling the stretch in a printing web or substrate in which a cushion of air or other suitable gas is provided between the web and the top of a height-adjustable post. At the very least, the invention provides an alternative to presently proposed methods and means of controlling the stretch in printing webs.

DISCLOSURE OF THE INVENTION

According to the present invention, there is provided a printing web distortion device for imposing a measured amount of distortion into a moving web or substrate, such as paper or the like, to compensate for lateral stretching thereof during a printing operation, said device comprising a vertically adjustable post with a gas nozzle disposed at or adjacent to the tip thereof for generating a cushion of gas, a support enclosure for said post with a source for pressurised gas associated therewith, said post being longitudinally slideable within said support enclosure whereby said tip is either raised so that it approaches said substrate in a first operating mode whereby said post imposes said stretch compensating distortion by the application of an elevating force provided by the vertically adjustable post between the tip of which and the moving substrate there is provided the said cushion of gas, especially air, or in a second idle mode, said post is withdrawn from said substrate so that no elevating force is provided on the substrate.

Preferably, the nozzle is formed in the shape of a slot which is transverse to the path of the moving web substrate so as to improve the shape and effect of the air cushion on the substrate.

Preferably, the support enclosure includes a cylinder within which said post is able to slide.

Preferably, said support enclosure includes means for varying the volume and/or pressure of the gas emanating from said nozzle in accordance with the position of the post within said enclosure, that is to say the relative height to which the post is adjusted when in its operating mode. More preferably, said means for varying the volume and/or pressure of said gas includes a series of ports that are progressively uncovered as the post approaches the substrate. In this way, a suitable void is maintained between said post and said substrate, irrespective of the height of the post, since increasing resistance is encountered from said substrate with increasing height of the post (ie with increased distortion of the substrate), which would otherwise tend to cause the substrate to be drawn down onto the tip of the post. Variation in gas flow is thereby achieved as a result of the operation of the device itself and no adjustment is required to the external air pressure supply.

Thus, in a preferred embodiment, the post includes an internal central conduit, one end of which is in communication with said nozzle and the other end, during use of said device, is in communication with said source of pressurised gas and wherein said means for varying the volume and/or pressure of said gas comprises a plurality of spaced ports, preferably of varying diameters, disposed in the path of the gas, one or more of which are progressively uncovered as the height of the post is increased. During use of said device displacement of said post operates to vary the number of or choice of port or ports in communication with said source of pressurised gas and thus to increase the volume and/or pressure of gas emanating from said nozzle as the post rises.

Preferably, in one embodiment of the invention, there is provided a post assembly comprising a post, a downwardly depending stem integral therewith and adjustment means associated therewith to adjust the height to which the post may be extended. The means to raise the post to the operating position, is provided by means of gas pressure acting on the base of the post. This is achieved, for example, by providing a chamber which is formed between the base of said post and a sealing collar which is suitably secured to the lower extremity of the said support enclosure and into which compressed air is introduced. A retaining means is fastened to the lower extremity of said support enclosure to secure the sealing collar. Preferably the post is returned to its idle position by means of a coil spring operating on the post assembly when the gas pressure is turned off and the pressure exhausted. It will be appreciated that the sealing collar limits the downward travel of the post assembly.

Preferably, the means to limit the height to which the post extends during the operating mode (ie when operated upon by the gas pressure), is provided by adjustment means in the form of a screw adjustment facility operating directly on the post. This is achieved in the present embodiment wherein the post is provided with the downwardly depending stem which passes through the sealing collar, and which is linked by means of a screw thread on the lower end of said stem which mates with a corresponding thread located internally in an adjustment knob which is able to be rotated progressively to vary the amount by which the tip of the said post is able to extend above the support enclosure, thus determining the height to which the post may be raised under the influence of the gas pressure.

The above mentioned retaining means furthermore provides a mechanical stop for the upward travel of the rotatable adjustment knob, thereby limiting the upward travel of the post assembly, the extent to which the post itself is able to be raised being determined by the relative position of the adjustment knob. The coil spring is conveniently located between a lower surface of the retaining means and an upper surface of the adjustment knob. It will be readily appreciated that several mechanical equivalents of such an arrangement are possible, including the provision of appropriate recesses within either or both of the retaining means or adjustment knob to accommodate the spring. Indeed, where the adjustment knob itself is partly located within a recess in the retaining means, a graduation scale may be incorporated to facilitate accurate adjustment.

In this embodiment, the components interact to form a device, in which the post has a continuously adjustable travel stroke within a desired range, and which is operable between a predetermined adjustable height to cause the required distortion of the substrate during printing. When deactivated the post will reliably return to its idle or home position.

It will be further understood that whilst it is generally preferable to provide independent supplies of compressed gas to lift the post on the one hand and to provide the cushion of gas at the tip of the post on the other, it will also be possible to have a single supply carry out both functions by having the central conduit described above extend downwardly into the aforementioned chamber. There are however limitations arising from this arrangement due to the need to more accurately control the rate of flow of compressed gas.

In an alternate embodiment, the means to raise the post, lower the post to its idle position and provide adjustment in the height to which it is raised are accomplished by means of a motor instead of gas pressure, return coil spring and adjustment knob.

Thus in one preferred form of this alternate embodiment, the post itself is provided with an internally threaded area which is engaged by means of its screw threads to a lead screw fitted to a motor which is secured to the base of said support enclosure whereby rotation of the motor and thus the fitted lead screw displaces the post on said threads, causing it to travel up or down within the support enclosure in order to withdraw the post from or cause it to approach said substrate. It will be appreciated that both the aforementioned adjustment in the height to which the post may be raised, as well as the mechanism by which the post is raised and returned between its idle and operating positions is thereby accomplished through the use of the motor as a positive drive.

BRIEF DESCRIPTION OF THE DRAWINGS

Two preferred forms of this invention will now be described with reference to the attached drawings in which.

BEST MODE OF CARRYING OUT THE INVENTION

Figures 1, 2, 3:
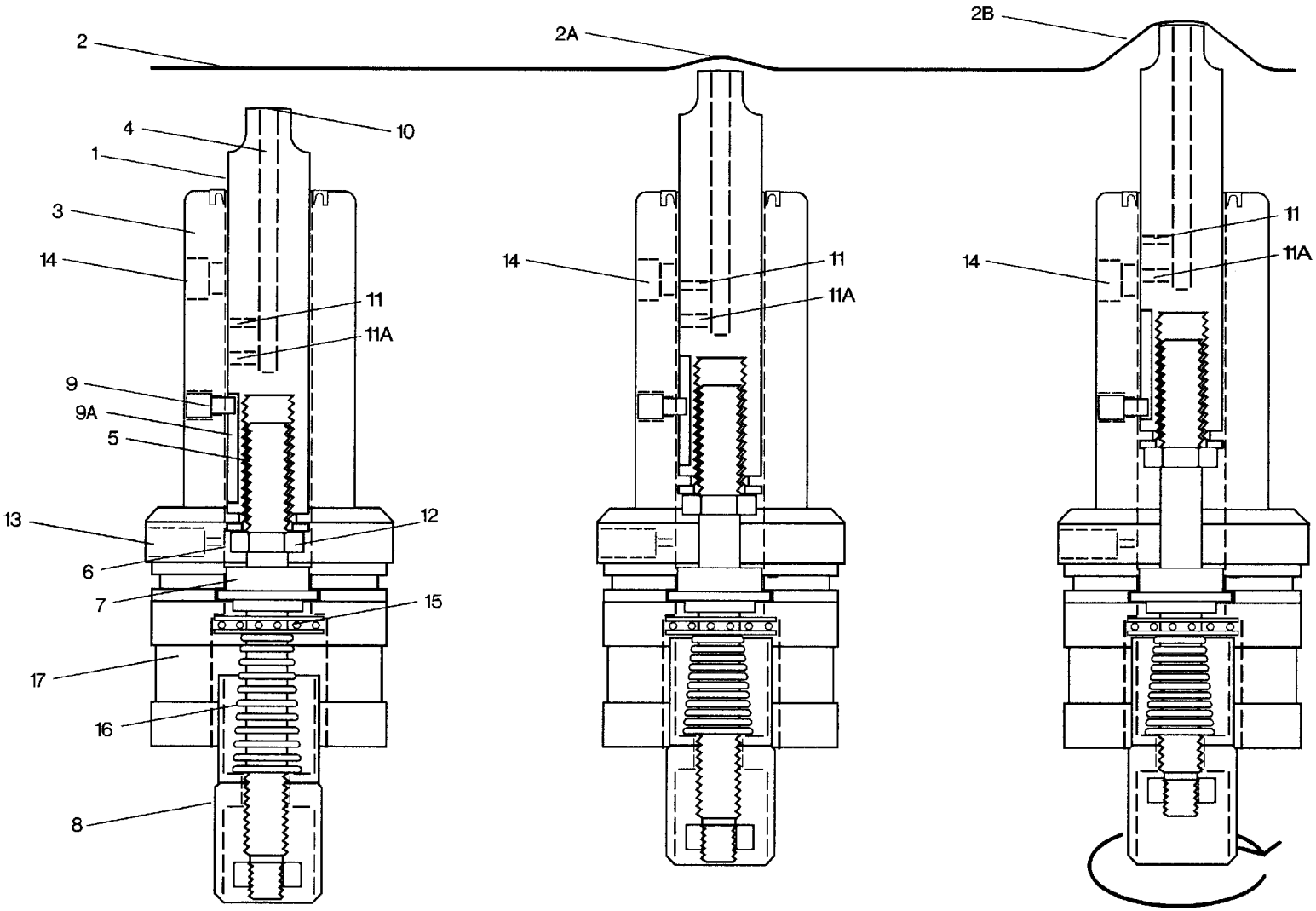
FIG. 1 shows a cross-sectional elevation of a first embodiment according to the invention, which utilises compressed gas to raise the post, and a screw adjustment means associated therewith, the post being shown at its home or idle position.
FIG. 2 shows the embodiment of FIG. 1, with the post raised in its operating position, the post being adjusted at an intermediate position.
FIG. 3 shows the embodiment of FIG. 1, with the post raised in its operating position, the post being adjusted at an upper position.

Referring generally to FIG. 1, there is depicted a device for imposing a measured amount of distortion into a moving web or substrate which comprises an upstanding air post 1 that is located below a web substrate 2 and is able to slide in a fixed cylinder 3. The path of the web substrate here is taken as perpendicular to the page.

There is an internal air passage 4 in the upper portion of the post 1. The lower portion of the post 1 is threaded so as to fit over a corresponding externally threaded stem 5, to which it is locked by means of a tightened nut 6. This stem 5 is able to slide vertically within a sealing bush 7 associated with the cylinder 3.

The post 1 and the stem 5 to which it is secured move against the bias of a coil spring 16. An adjustment knob 8 is engaged by screw thread with the lower portion of stem 5. The knob 8 provides a housing for the spring 16 and is formed as a separate component. Rotating the knob 8 increases or decreases the potential travel of the post 1 within cylinder 3 when pressurised air is supplied to chamber 12 through inlet 13.

The post 1 is anchored against rotation within the cylinder by means of a grub screw 9. The post however is able to slide vertically along the length of the slot 9A. The upper portion of the air passage 4 terminates at a slotted nozzle 10 as described more fully with reference to FIG. 7.

The cylinder 3 incorporates a separate air inlet 14, which is constantly pressurised by a low-pressure air supply. Inlet 14 comes into communication with ports 11 and 11A only when the post 1 is vertically activated by air pressure in chamber 12.

Before the application of air pressure at chamber 12, the post 1 is substantially withdrawn into the fixed cylinder 3 by virtue of its weight and the action of the coil spring 16 (see FIG. 1). As air pressure is applied to chamber 12 through inlet 13 this pressure acts upwardly on the bottom area of the post 1 so that the post 1 together with the stem 5 and the knob 8 rise vertically toward the substrate 2A as depicted in FIG. 2. Depending on the relative position of the adjustment knob 8 on the threaded stem 5 and its proximity to the post 1, the post 1 will rise vertically until the upper edge of the knob 8 meets the lower edge of a thrust bearing 15, which is adjacent to the opposing edge of the retaining means in the form of a return block 17.

The purpose of the thrust bearing 15 is to provide a smooth rotation of the knob 8 against the effect of the air pressure. The upward stroke of the post 1 and its subsequent approach to the substrate 2A will therefore be progressively controlled by the rotation of the knob 8, as in FIG. 3. When greater deformation of the web substrate 2B is required, the stem 5 and post 1 can be raised relatively to the fixed cylinder 3 as shown in FIG. 3 by rotating the knob 8 further.

As the post 1 rises vertically within the fixed cylinder 3, the port 11 comes into communication with the low pressure air inlet 14 to provide air to the internal air passage 4 (as at FIG. 2) which then provides the cushion of gas at the slotted nozzle 10. As the knob 8 is rotated and the post 1 rises, the air inlet 14 communicates with port 11A (as at FIG. 3) which having a greater diameter increases the volume of gas emanating from the slotted nozzle 10. This increased volume of gas counteracts the increased resistance from the distorted substrate 2B. The higher operating position of the post 1 and increased air cushion pressure thus causes a greater degree of substrate deformation 2B.

When the air supply at inlet 13 is terminated, the post 1 again retracts into the cylinder 3 under the influence of its own weight and the bias of the spring 16 as shown in FIG. 1. In operation the height of the post 1 would be monitored and adjusted as necessary by an operator to give the required stretch compensating deformation for a given printing process.

Figures 4, 5, 6:
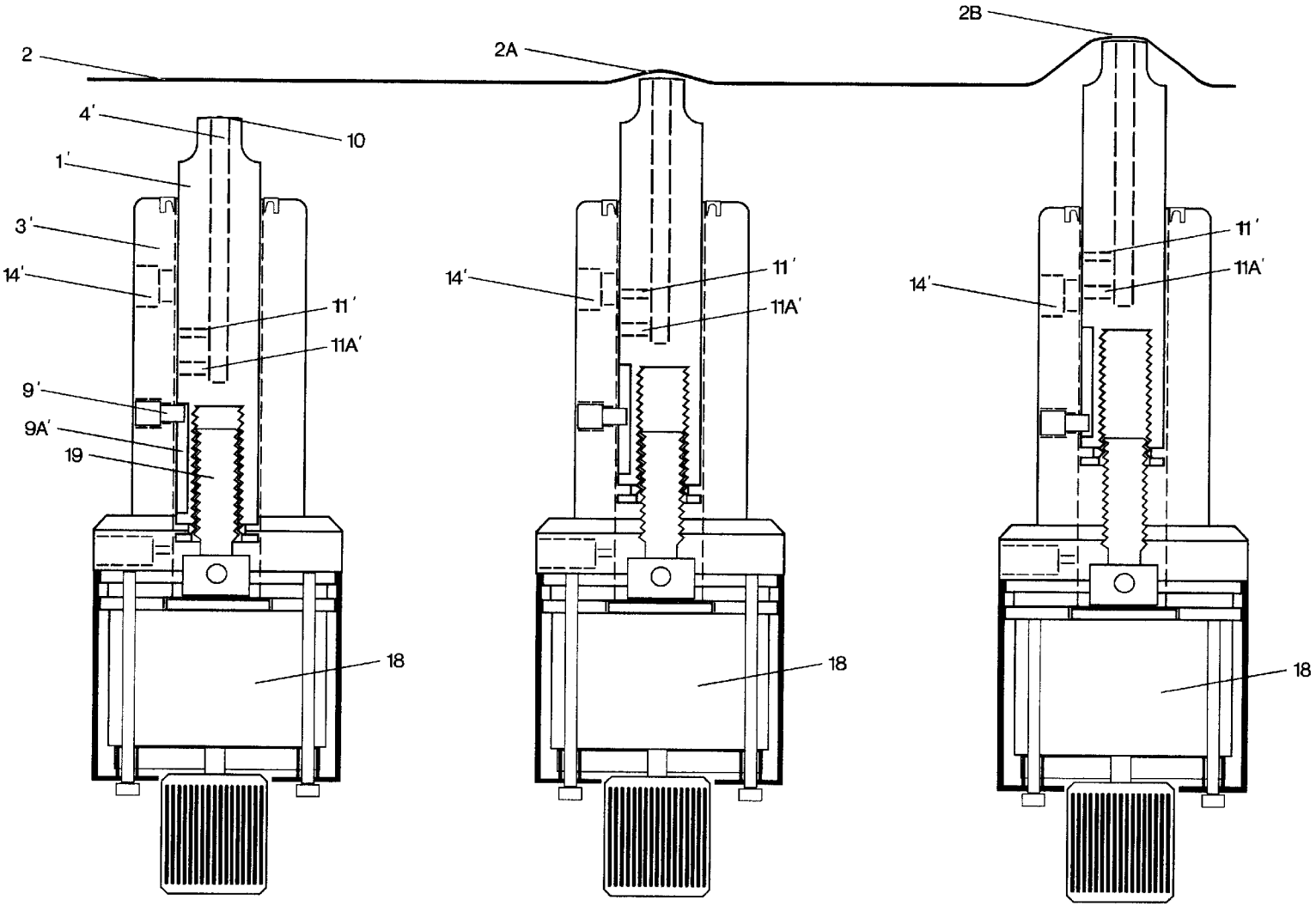
FIG. 4 shows a cross-sectional elevation of a second embodiment according to the invention, wherein a motor is utilised to raise and adjust the height of the post, the post being shown at its home or idle position.
FIG. 5 shows the embodiment of FIG. 4, with the post raised in its operating position, the post being adjusted at an intermediate position.
FIG. 6 shows the embodiment of FIG. 4, with the post raised in its operating position, the post being adjusted at an upper position.

With the second embodiment shown in FIGS. 4 to 6, the main components that correspond in function to those of FIGS. 1 to 3 are marked by the same numbers but with the addition of an accent (). In this embodiment, the stem 5 in the first embodiment illustrated in FIGS. 1 to 3, is replaced by the lead screw 19 which is fastened to the shaft of a step motor 18 which is in turn secured to the lower extremity of the cylinder 3'. As the step motor 18 is rotated the lead screw 19 is also rotated so that the post 1' is turned mechanically out of the fixed cylinder 3' rather than relying on the pressure of the air supply as with the first embodiment. The degree to which the post 1' is raised however still determines which port, 11' and/or 11A' comes into communication with the low pressure air supply 14' (see FIGS. 5 & 6) and thus the air volume/pressure exiting from the nozzle 10'.

Figure 7:
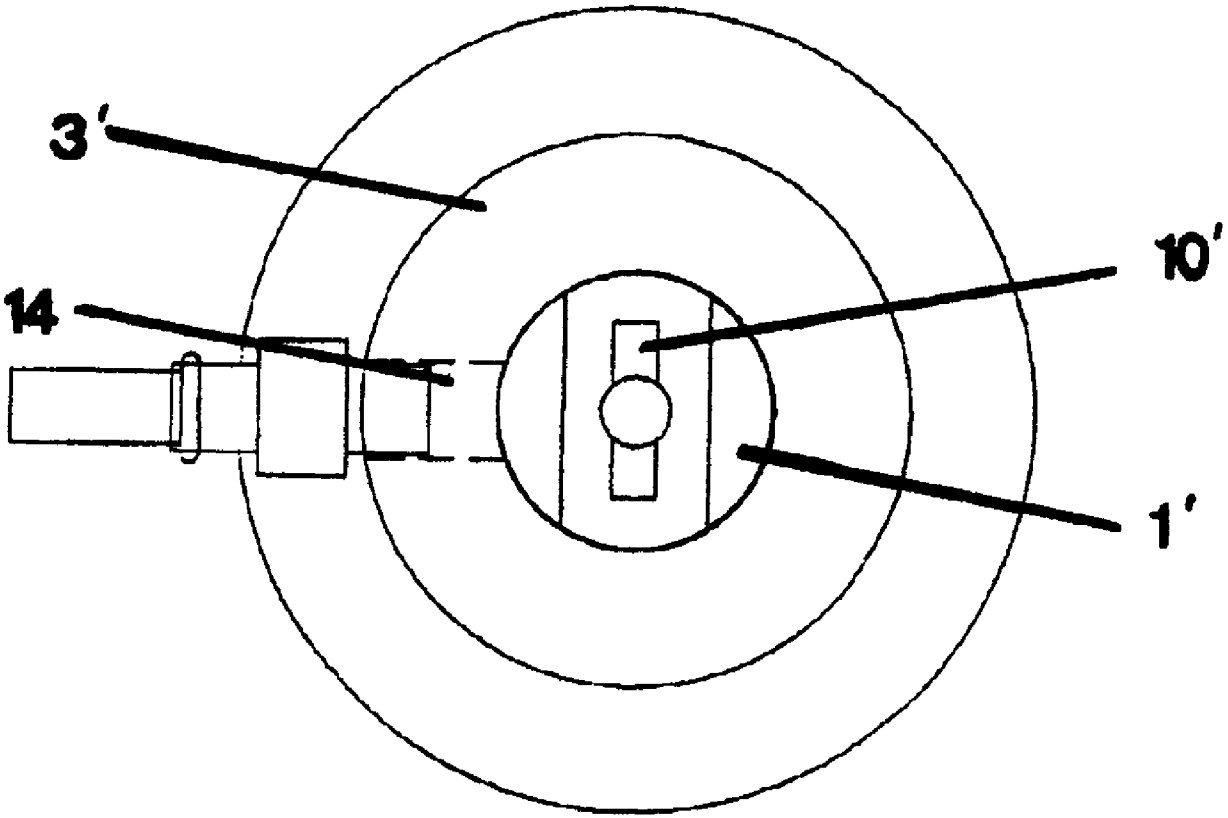
FIG. 7 shows a plan view of both embodiments, being a common view.

As shown in FIG. 7, the nozzle 10' is preferably formed in the shape of a slot which is transverse to the path of the web substrate so as to improve the shape and effect of the air cushion on the substrate.

In operation the level of the post 1' and the associated pressure of the air cushion with this second embodiment would be monitored and adjusted as necessary by a microprocessor to give the required stretch compensating deformation for a given printing process.

It should be noted at this point that the principles of operation are common to both embodiments of this invention with identical distortion performance properties. The first embodiment requires a manual adjustment during operation, the second embodiment has the adjustment effected by the installed step motor which is in turn controlled remotely from a console. The two embodiments share common components, these being the cylinder, and the nozzle post. One important difference is that in the first embodiment the internally threaded area in the nozzle post is utilised to secure the non-rotating stem 5 and in the second embodiment the internal threaded area is utilised to engage a rotating lead screw fitted to a step motor, with the purpose of displacing the said post. In the case of the first embodiment height adjustment is achieved by adjusting the position of the adjustment knob at the opposite end of the stem. A knob is also provided on the extended shaft of the step motor simply as an alternative manual adjustment at the unit.

It will thus be appreciated that this invention at least in the form of the embodiments disclosed provides a novel and useful improvement to offset printing presses. Clearly however the examples described are only the currently preferred forms of this invention and a wide variety of modifications may be made which would be apparent to a person skilled in the art. For example the shape and configuration of the post as well as the mounting assembly may be changed according to application or design preference. Also while the apparatus is currently manufactured from steel and/or aluminium the invention extends to the use of any other suitable material.

For the purposes of this specification expressions such as "vertical", "upstanding", "below" and "lateral" etc. refer to the device in a position of use as illustrated and are not to be read as necessarily limiting. Effective operation of the unit is possible regardless of orientation.

What is claimed is:

1. A printing web distortion apparatus for imposing a measured amount of distortion into a moving web or a substrate for compensating for lateral stretching thereof during a printing operation, said printing web distortion apparatus comprising:

a vertically adjustable post having a gas nozzle disposed at, or adjacent to, a tip of said vertically adjustable post for generating a cushion of gas; and, a support enclosure for said vertically adjustable post having a source for pressurized gas associated therewith, said vertically adjustable post being longitudinally slidable within said support enclosure so that said tip is either raised for approaching the substrate in a first mode, said first mode being an operating mode, wherein said vertically adjustable post imposes a stretch compensating distortion via application of an elevating force exerted by said vertically adjustable post between said tip and the substrate as the substrate is moving, said elevating force being provided by the cushion of gas, or in a second mode, said second mode being an idle mode, wherein said vertically adjustable post is withdrawn from the substrate and no elevating force is exerted on the substrate.

2. The printing web distortion apparatus according to claim 1, wherein said cushion of gas is a cushion of air.

3. The printing web distortion apparatus according to claim 1, wherein said gas nozzle is shaped as a slot transverse to a path of the moving web or the substrate for improving effectiveness of said cushion of gas on the substrate.

4. The printing web distortion apparatus according to claim 1, wherein said support enclosure includes a cylinder in which said vertically adjustable post is slidable.

5. The printing web distortion apparatus according to claim 1, wherein said support enclosure includes means for varying at least one of volume and pressure of said pressurized gas emanating from said gas nozzle according to a positioning of said vertically adjustable post within said support enclosure.

6. The printing web distortion apparatus according to claim 5, wherein said means for varying at least one of volume and pressure of said pressurized gas includes a series of ports that are progressively uncovered as said vertically adjustable post approaches the substrate for maintaining a void between said vertically adjustable post and the substrate, irrespective of the height of said vertically adjustable post.

7. The printing web distortion apparatus according to claim 5, wherein said vertically adjustable post includes an internal central conduit with a first end of said conduit communicating with said gas nozzle and a second end of the internal central conduit, during use of said printing web distortion apparatus, communicating with said source for said pressurized gas, said means for varying at least one of volume and pressure of said pressurized gas comprising a plurality of spaced ports disposed in a path of said pressurized gas with at least two spaced ports of said plurality of spaced ports being progressively uncovered as the height of said vertically adjustable post is increased.

8. The printing web distortion apparatus according to claim 7, wherein said plurality of spaced ports is comprised of spaced ports of varying diameters.

9. The printing web distortion apparatus according to claim 7, wherein said vertically adjustable post is displaceable for operatively varying a number of, and choice of, spaced ports of said plurality of spaced ports.

10. The printing web distortion apparatus according to claim 1, wherein said vertically adjustable post is a part of a post assembly comprising a downwardly depending stem integral with said vertically adjustable post and means for adjusting the height to which said vertically adjustable post is extendable.

11. The printing web distortion apparatus according to claim 10, wherein means for adjusting the height to which said vertically adjustable post is extendable to said operating mode is via gas pressure acting on a base of said vertically adjustable post.

12. The printing web distortion apparatus according to claim 11, wherein said vertically adjustable post is returned to said idle mode via a coil spring operating on said post assembly when said gas pressure is turned off and pressure is exhausted.

13. The printing web distortion apparatus according to claim 10, further comprising a sealing collar and a chamber with said chamber being between a base of said vertically adjustable post and said sealing collar, said sealing collar being secured to a lower extremity of said support enclosure into which a compressed gas is introduced.

14. The printing web distortion apparatus according to claim 13, wherein a single source of gas supplies both said source of said pressurized gas associated with said support enclosure and said compressed gas.

15. The printing web distortion apparatus according to claim 13, further comprising retaining means fastened to the lower extremity of said support enclosure for retaining said sealing collar.

16. The printing web distortion apparatus according to claim 15, wherein means for adjusting the height to which said vertically adjustable post is extendable during said operating mode is via a screw adjustment facility operating directly on said vertically adjustable post.

17. The printing web distortion apparatus according to claim 16, wherein said vertically adjustable post includes a downwardly depending stem passing through a sealing collar linked to a lower end of said downwardly depending stem via a screw thread, said screw thread mating with a corresponding thread internally located in an adjustment knob progressively rotatable for varying an amount by which said tip of said vertically adjustable post is extendable above said support enclosure for determining a height to which said vertically adjustable post is raisable via said pressurized gas.

18. The printing web distortion apparatus according to claim 17, wherein said retaining means includes a mechanical stop for an upwardly movement of said adjustment knob for limiting upward vertical movement of said post assembly, with upward vertical movement of said vertically adjustable post being limited via a positioning of said adjustment knob.

19. The printing web distortion apparatus according to claim 17, further comprising a coil spring located between a lower surface of said retaining means and an upper surface of said adjustment knob.

20. The printing web distortion apparatus according to claim 17, wherein said adjustment knob is partly located within a recess in said retaining means with said retaining means including a graduation scale for facilitating an accurate adjustment.

21. The printing web distortion apparatus according to claim 1, wherein said cushion of gas generated at said tip of said gas nozzle and said source of said pressurized gas of said support enclosure emanate from independent sources of compressed gas.

22. The printing web distortion apparatus according to claim 1, wherein said elevating force is provided by a motor.

23. The printing web distortion apparatus according to claim 22, wherein said vertically adjustable post has an internally threaded area engaged via a lead screw fitted to said motor secured to a base of said support enclosure, so that rotation of said motor and said lead screw jointly displace said vertically adjustable post along said internally threaded area and threads of said lead screw for causing upward vertical displacement and downward vertical displacement of said vertically adjustable post within said support enclosure for withdrawn said vertically adjustable post from, or causing said vertically adjustable post to approach, the substrate.

* * * * *